US005678597A

United States Patent [19]

Tuomela et al.

[11] Patent Number: 5,678,597

[45] Date of Patent: Oct. 21, 1997

[54] CLOSURE ARRANGEMENT FOR A TOILET SYSTEM WITH A CLOSED COLLECTION TANK

[75] Inventors: Jari Tuomela, Södertälje; Anders Örjes, Tyresö, both of Sweden

[73] Assignee: Evac International Oy, Helsinki, Finland

[21] Appl. No.: 674,579

[22] Filed: Jul. 5, 1996

[30] Foreign Application Priority Data

Jul. 7, 1995 [SE] Sweden ..... 9502506

[51] Int. Cl.[6] ..... F16L 5/00; E03D 1/00

[52] U.S. Cl. ..... 137/360; 137/381; 4/323

[58] Field of Search ..... 4/323; 137/360, 137/377, 381

[56] References Cited

U.S. PATENT DOCUMENTS

| | | | |
|---|---|---|---|
| 1,096,278 | 5/1914 | Sutton | 137/359 |
| 1,179,566 | 4/1916 | Shepperson . | |
| 2,851,286 | 9/1958 | Bishop | 137/359 |
| 4,069,952 | 1/1978 | Martin . | |
| 4,114,203 | 9/1978 | Carolan | 4/323 |
| 5,237,709 | 8/1993 | Byerly et al. . | |

*Primary Examiner*—A. Michael Chambers
*Attorney, Agent, or Firm*—Smith-Hill and Bedell

[57] ABSTRACT

A connection arrangement for a toilet system having an emptying tube connected to a closed sewage collection tank. The emptying tube has an end portion that extends through a wall and has a free end that projects from the wall for receiving in a socket of a coupling hose. A cover is attached to the wall and is moveable relative to the wall between an open position, in which the cover allows free access to the free end of the emptying tube for emptying the sewage collection tank, and a closed position, in which the cover protects the free end of the emptying tube against contamination and damage. A plug is attached to the cover and engages the free end of the emptying tube when the cover is in the closed position and is disengaged from the free end of the emptying tube when the cover is moved from the closed position to the open position. When the cover is in its closed position, it defines with the wall a space that is substantially larger than the space occupied by the free end of the emptying tube, whereby the free end of the emptying tube is reliably protected from contamination and damage.

14 Claims, 3 Drawing Sheets

CLOSURE ARRANGEMENT FOR A TOILET SYSTEM WITH A CLOSED COLLECTION TANK

BACKGROUND OF THE INVENTION

This invention relates to a closure arrangement for a toilet system including a closed sewage collection tank, i.e. a collection tank in which the sewage is stored until the tank can conveniently be emptied. This type of toilet system have been in use for several years, for instance in stationary installations in thinly populated areas where there is no municipal sewer system and in mobile installations, in particular on trains and boats.

A toilet system having a closed sewage collection tank may be provided with an emptying tube that is connected to the tank and has a free end that can be connected to a hose for emptying the sewage collection tank. The free end of the emptying tube is closeable by means of a cap or plug which is removed from the end of the emptying tube in order to allow the collection tank to be emptied. In a toilet system of this kind it is essential that the emptying tube free end be sealed effectively through a sealing element, and further the tube end should be protected against contamination and damage.

SUMMARY OF THE INVENTION

The object of the present invention is to provide a closure arrangement which ensures effective sealing of the free end of the emptying tube which protects the free end against contamination and damage.

In accordance with the invention there is provided a connection arrangement for a toilet system including a closed sewage collection tank having an emptying tube with an end portion that extends through a wall for emptying the collection tank, wherein the connection arrangement includes a cover attached to the wall and moveable relative to the wall between an open position, in which the cover allows free access to the free end of the emptying tube for emptying the collection tank, and a closed position, in which the cover protects the free end of the emptying tube against contamination and damage, and a sealing member attached to the cover, the sealing member engaging the free end of the emptying tube when the cover is in the closed position and being disengaged from the free end of the emptying tube when the cover is moved from the closed position to the open position, and wherein the free end of the emptying tube projects from the wall for being received in an end socket of a coupling hose, and the cover, when in the closed position, defines with the wall a space that is substantially larger than the space occupied by the free end of the emptying tube, whereby the free end of the emptying tube is reliably protected from contamination and damage.

The connection arrangement according to the invention may be applied with particular advantage to a toilet system, in particular a vacuum toilet system, on a railroad train. In a vacuum toilet system, otherwise known as a vacuum sewer system, a normally-closed discharge valve is connected between the outlet of the toilet bowl and the sewer pipe, and a blower or ejector, for example, is used to establish a considerable partial vacuum (typically about 0.3 to 0.5 bar below atmospheric, i.e. 0.7 to 0.5 bar absolute) in the sewer pipe immediately downstream of the discharge valve while the discharge valve is still closed. When the discharge valve is opened in response to a flush command, the contents of the toilet bowl are forced almost instantaneously into the sewer pipe and are propelled at high speed along the sewer pipe towards a sewage collection container. In some instances, the sewage collection tank itself is placed under vacuum, and in others, it is not.

A vacuum toilet system with a closed sewage collection tank may have an air supply tube for supplying air to aid in emptying the sewage collection tank and a supply tube for rinse water for a rinse arrangement. The free ends of the air and water supply tubes are then suitably arranged parallel and close by the free end of the emptying tube. In this fashion, all three of the tubes cooperate with respective sealing elements, which are secured to the cover. In this way, all three tubes are sealed by closing the cover.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1A:
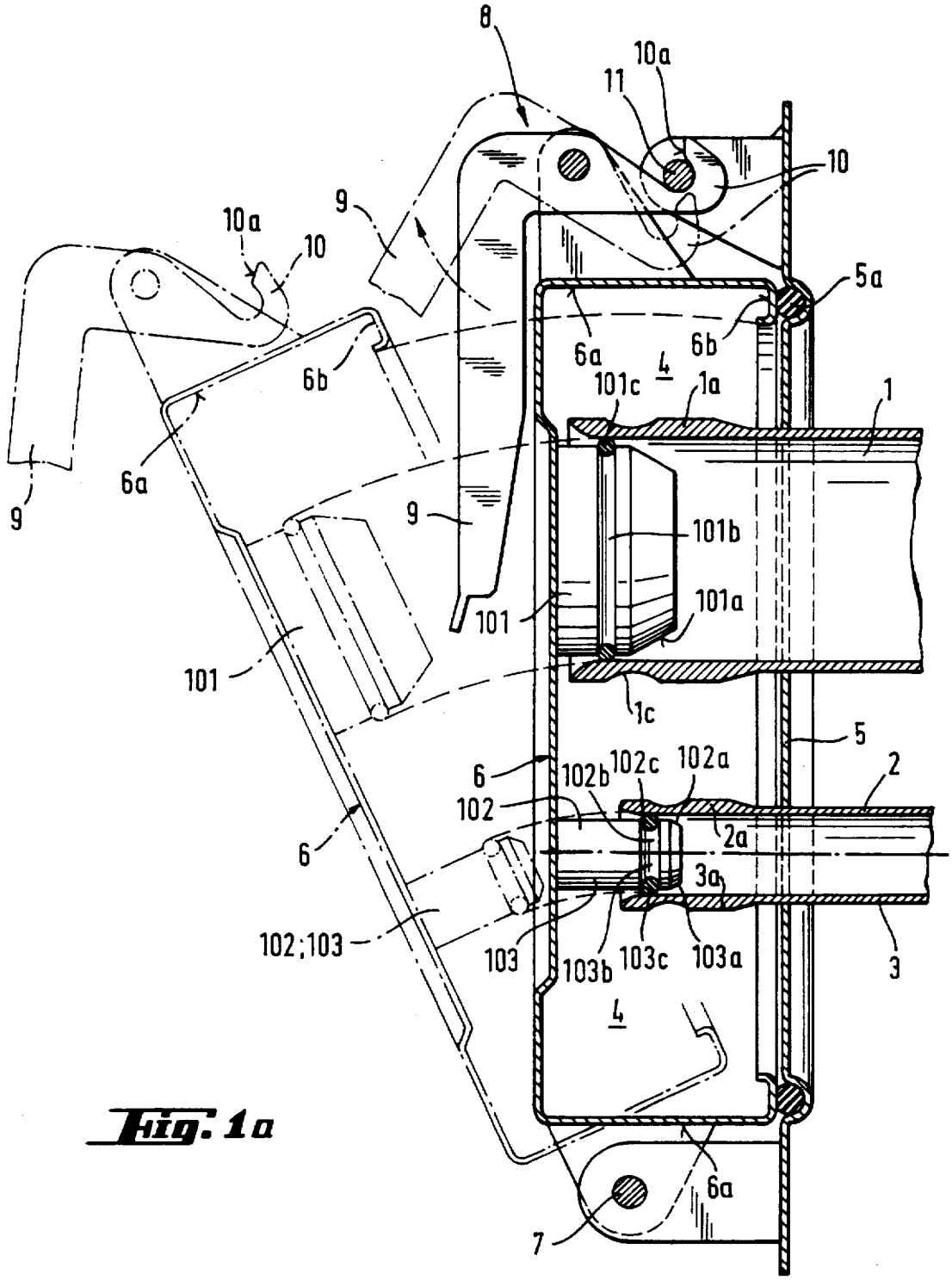
FIG. 1*a* is a partial sectional view illustrating a connection arrangement for servicing a vacuum toilet system having a closed sewage collection tank, with the cover of the connection arrangement in closed position.
Figure 1B:
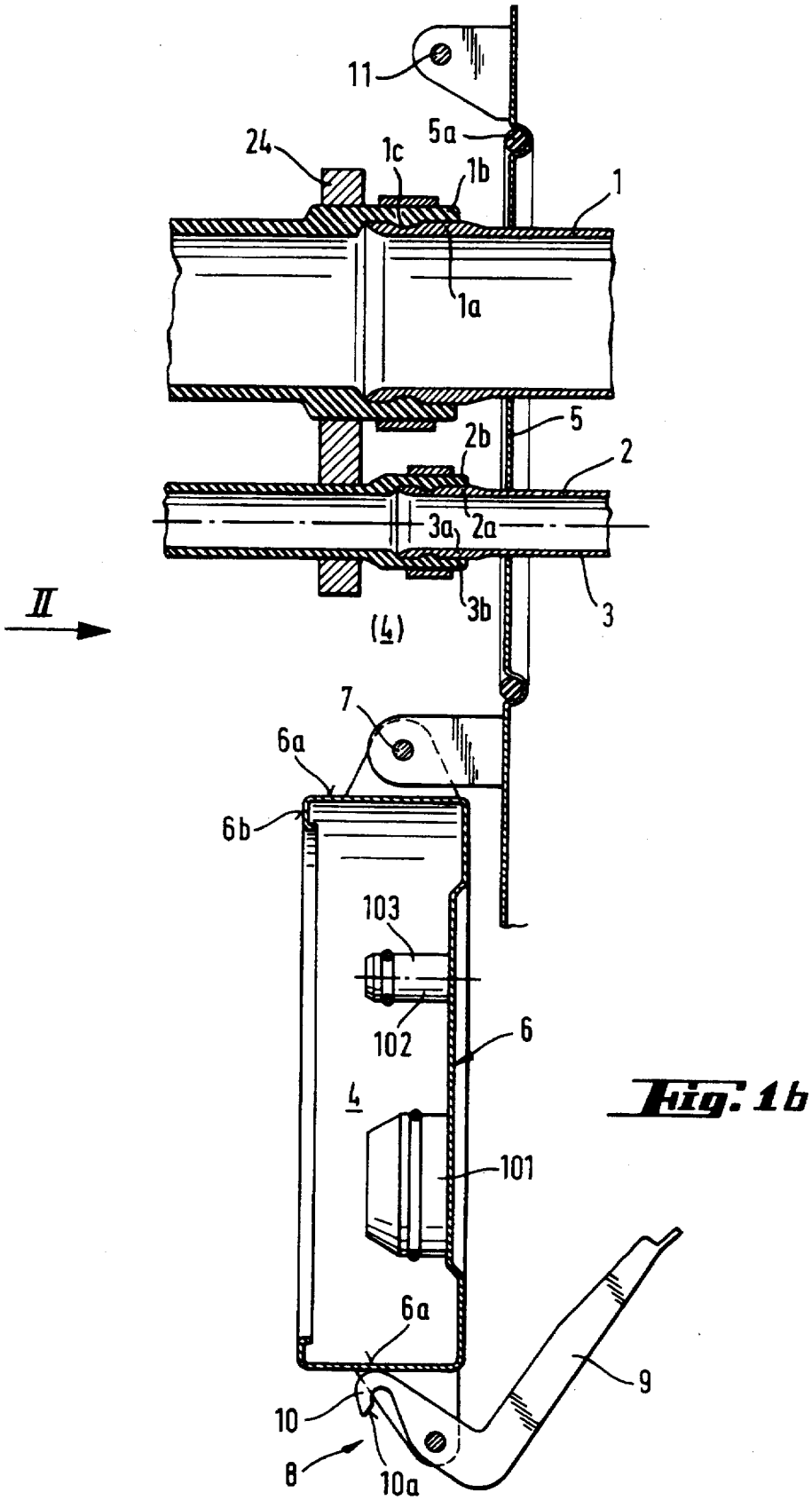
FIG. 1*b* is a view similar to FIG. 1*a* with the cover in fully open position and also illustrates hoses for servicing the vacuum toilet system.
Figure 2:
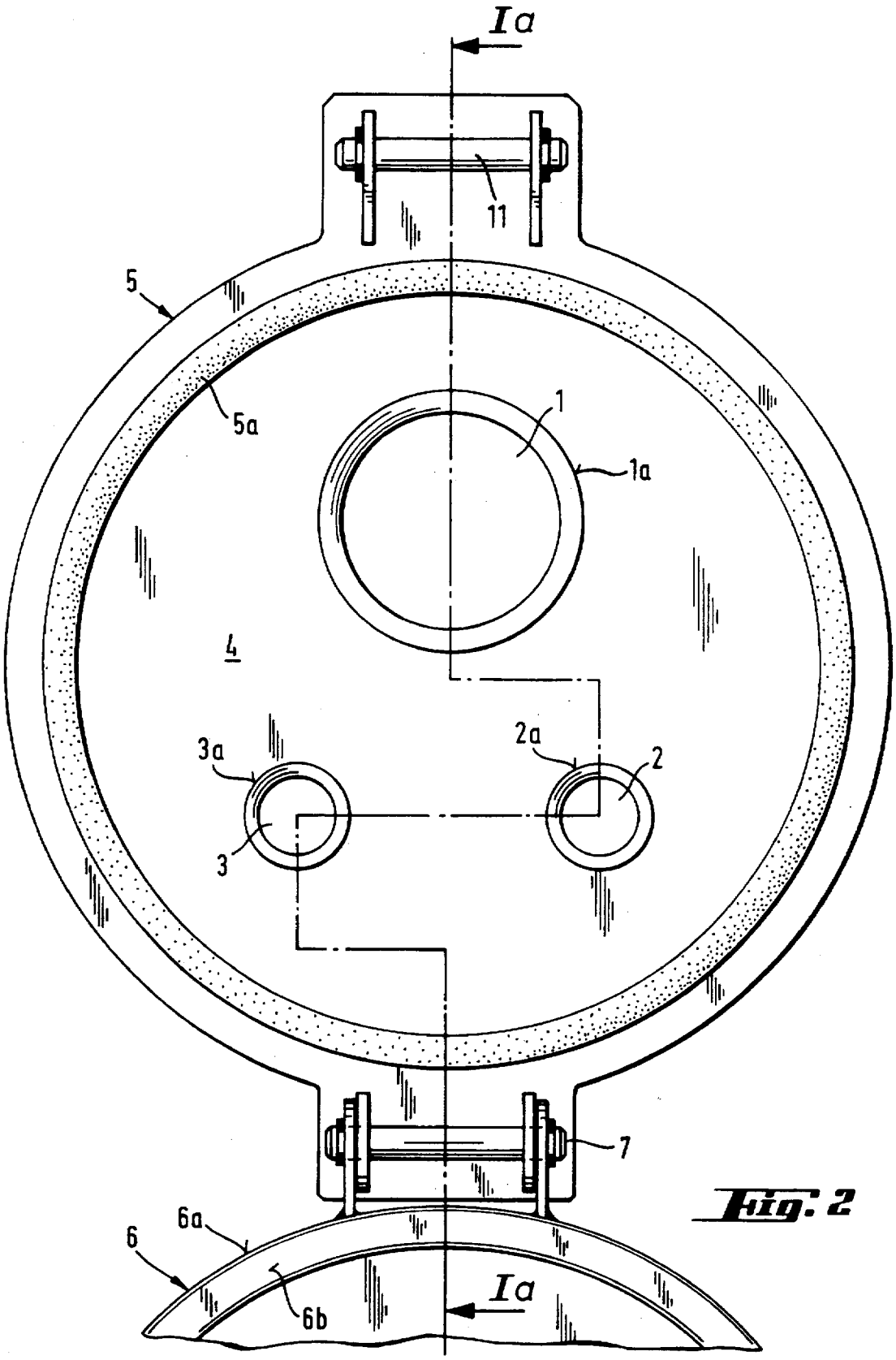
FIG. 2 is a front view of the connection arrangement taken from the left of FIG. 1*b* and illustrates the section line Ia–Ia on which the sectional view of FIG. 1*a* is taken.

FIGS. 1*a* and 1*b* illustrate a wall 5 having a through hole through which an end portion of an emptying tube 1 for a closed sewage collection tank (not shown) extends. The tank is part of a toilet system, which may be a gravity toilet system although it is preferred that it be a vacuum toilet system. The toilet system may be installed in a passenger car of a railroad train, in which case the wall 5 is an exterior wall of the passenger car, at which service persons attend to emptying the tank and other service functions. The toilet system also includes a rinse water container for supplying rinse water to the toilet bowl in response to a flush command. During servicing of the toilet system, it is necessary to drain the sewage collection tank and replenish the rinse water supply tank.

The free end of the emptying tube 1 is provided with a spigot element 1*a* of a bell-and-spigot joint. A mating bell element 1*b* is provided on the free end of a hose, whose other end (not shown) may debouch into a municipal sewer. The spigot element projects sufficiently beyond the wall 5 to allow the bell element 1*b* to fit securely over the spigot element 1*a*. The spigot element 1*a* is formed with an annular recess 1*c* at its exterior. The interior of the bell element engages the annular groove in the external surface of the spigot element for obtaining secure and leakproof operation. Similarly, an air inlet tube 2 and a rinse water feeding tube 3 also have end portions that extend through respective holes in the wall 5 and are equipped with spigot elements 2*a* and 3*a* for mating engagement with bell elements 2*b* and 3*b* on the free ends of, respectively, an air supply hose and a water supply hose. The air supply hose is used to supply air to the collection tank to aid in draining of the collection tank. Air under pressure may be used to force the sewage for the collection tank. The rinse water feeding hose supplies water for replenishing the rinse water container. As shown in FIG.

1b, the bell elements 1b, 2b and 3b may be attached to a mounting plate 24, so that all three bell elements can be applied simultaneously to the respective spigot elements and to ensure that each bell element is applied to the proper spigot element.

A cover 6 is turnably journalled to the wall 5 for movement about an axis 7 that is outside the cover and is spaced from the outer surface of the wall 56. The cover 6 is pivotable between a closed position (FIG. 1a) and an open position (FIG. 1b). The cover is held in its closed position by means of a latch 8 engaging a pin 11. The latch 8 includes a hook 10 which is released from the pin 11 by turning a handle 9 in the clockwise direction seen in FIG. 1a. When the cover is turned from its open position to its closed position, a camming surface 10a of the hook 10 engages the pin 11 and the hook 10 is pivoted in the counterclockwise direction, and when the cover is fully closed, the hook snaps back behind the pin 11, holding the cover in the closed position. Because the pin 11 is slightly below the turning axis of the hook 11, the closing mechanism is self-locking.

The cover 6 is circular and has a peripheral wall 6a that terminates in an inturned lip 6b. The wall 5 has an annular groove that receives a sealing ring 5a. When the cover is in its closed position, the lip 6b engages the sealing ring 5a for effectively sealing the space 4 defined between the cover 6 and the wall 5. The sealing ring 5a is compressed when the cover is in the closed position.

Three sealing plugs 101, 102 and 103 are secured to the cover 6. The sealing plugs 101, 102, and 103 are positioned for entering the spigot elements 1a, 2a and 3a of the tubes 1, 2 and 3 respectively when the cover 6 is in its closed position. Thus, when the cover 6 is in its closed position, the tubes 1, 2 and 3 are effectively sealed by the respective plugs, whereas when the latch 8 is released by pulling on the handle 9, and the cover is pivoted to its fully open position, the plugs are automatically removed allowing ready access to the spigot elements of the tubes 1, 2 and 3. Because the plugs are attached to the cover 6, there is no danger of a service person misplacing a plug or forgetting to install a plug in the proper spigot element.

It will be noted that the interior surfaces of the spigot elements 1a, 2a and 3a flare slightly at their outer ends and that the sealing plugs have tapered leading edges 101a, 102a, and 103a. The combination of the flaring at the outer ends of the spigot elements and the tapering of the inner ends of the plugs allows the plugs to be inserted in the respective spigot elements even though the plugs move toward the sealing position along a curved path rather than a rectilinear path. Also, the sealing plugs are formed with respective peripheral grooves 101b, 102b and 103b in which O-rings 101c, 102c and 103c are respectively placed. The O-rings seal against the interior surfaces of the respective spigot elements, ensuring a tight seal.

It will be seen that the volume of the interior space of the cover 6 is substantially larger than the minimum volume required to enclose the free ends of the tubes 1, 2 and 3, so that there is substantial clearance between the peripheral wall 6a and the spigot elements. Therefore, the connection arrangement shown in the drawings allows the ends of the tubes 1, 2 and 3 to be protected from contamination and damage in a reliable fashion, yet when the cover is turned to its fully open position, the spigot elements are immediately accessible. When the cover is returned to its closed position, the ends of the tubes are automatically sealed.

It will be appreciated that the invention is not restricted to the particular embodiment that has been described, and that variations may be made therein without departing from the scope of the invention as defined in the appended claims and equivalents thereof. In particular, the invention is not restricted to the cover 6 being provided in conjunction with the emptying tube 1, the air inlet tube 2 and the rinse water feeding tube 3. For example, a tube for supplying cleaning liquid to the sewage collection tank could be provided inside the cover, in addition to the connections for the tubes 1, 2 and 3.

We claim:

1. A connection arrangement for a toilet system including a closed sewage collection tank and at least first and second tubes each having an end portion that extends through a wall for servicing the toilet system, and wherein the first tube is an emptying tube for emptying the sewage collection tank and the connection arrangement includes:

a cover attached to the wall and moveable relative to the wall between an open position, in which the cover allows free access to the free ends of the tubes for servicing the toilet system, and a closed position, in which the free ends of the tubes are enclosed by the cover and are protected against contamination and damage, and at least a first sealing member attached to the cover, the sealing member engaging the free end of the first tube when the cover is in the closed position and being disengaged from the free end of the first tube when the cover is moved from the closed position to the open position, and wherein the cover, when in the closed position, defines with the wall a space that is substantially larger than the space occupied by the free ends of the first and second tubes, whereby the free end of the first and second tubes are reliably protected from contamination and damage.

2. A connection arrangement according to claim 1, wherein the cover, when in the closed position, engages the wall along a path that surrounds the free ends of the first and second tubes.

3. A connection arrangement according to claim 2, comprising a seal member attached to the wall, and wherein the cover engages the seal member when in the closed position.

4. A connection arrangement according to claim 1, wherein the second tube is an air inlet tube connected to the tank for allowing entrance of air during emptying of the tank, and wherein the arrangement further comprises a sealing member attached to the cover and engaging the free end of the air inlet tube when the cover is in the closed position and being disengaged from the free end of the air inlet tube when the cover is moved from the closed position to the open position.

5. A connection arrangement according to claim 1, wherein the second tube is a feeding tube for feeding rinse water to a rinse water container, and wherein the arrangement further comprises a sealing member attached to the cover and engaging the free end of the rinse water feeding tube when the cover is in the closed position and being disengaged from the free end of the rinse water feeding tube when the cover is moved from the closed position to the open position.

6. A connection arrangement according to claim 1, wherein the cover is attached to the wall for pivotal movement relative to the wall between the open position and the closed position.

7. A connection arrangement according to claim 6, wherein the pivot axis is outside the space defined by the cover and the wall when the cover is in the closed position.

8. A connection arrangement according to claim 1, wherein the sealing member comprises a tapered plug that fits into the free end of the tube when the cover is moved from the open position to the closed position.

9. A connection arrangement according to claim 8, wherein the tapered plug is formed with an annular groove and the connection arrangement includes a sealing ring fitted in the annular groove and sealing against the interior of the free end of the tube.

10. A connection arrangement according to claim 9, wherein the tube end flares outwardly.

11. A connection arrangement according to claim 1, comprising a self-locking latch mechanism for securing the cover in its closed position.

12. A connection arrangement according to claim 1, wherein the second tube is a feeding tube for feeding cleaning liquid to the sewage collection tank, and wherein the arrangement further comprises a sealing member attached to the cover and engaging the free end of the cleaning liquid feeding tube when the cover is in the closed position and being disengaged from the free end of the cleaning liquid feeding tube when the cover is moved from the closed position to the open position.

13. A connection arrangement according to claim 1, wherein the end portion of the first tube is provided with a locking element for engagement with a complementary element of a socket.

14. A connection arrangement for a toilet system including a closed sewage collection tank having an emptying tube with an end portion that extends through a wall for emptying the collection tank, wherein the connection arrangement includes:

a cover attached to the wall and moveable relative to the wall between an open position, in which the cover allows free access to the free end of the emptying tube for emptying the collection tank, and a closed position, in which the cover protects the free end of the emptying tube against contamination and damage, and a sealing member attached to the cover, the sealing member engaging the free end of the emptying tube when the cover is in the closed position and being disengaged from the free end of the emptying tube when the cover is moved from the closed position to the open position, and wherein the free end of the emptying tube projects from the wall for being received in an end socket of a coupling hose, and the cover, when in the closed position, defines with the wall a space that is substantially larger than the space occupied by the free end of the emptying tube, whereby the free end of the emptying tube is reliably protected from contamination and damage.

* * * * *